US011001486B2

(12) United States Patent
Parsons

(10) Patent No.: US 11,001,486 B2
(45) Date of Patent: May 11, 2021

(54) CAPPING SYSTEM

(71) Applicant: BLACKHAWK MOLDING CO., INC., Addison, IL (US)

(72) Inventor: Roy F. Parsons, Shelby, NC (US)

(73) Assignee: BLACKHAWK MOLDING CO., INC., Addison, IL (US)

( * ) Notice: Subject to any disclaimer, the term of this patent is extended or adjusted under 35 U.S.C. 154(b) by 0 days.

(21) Appl. No.: 16/164,125

(22) Filed: Oct. 18, 2018

(65) Prior Publication Data

US 2019/0047835 A1 Feb. 14, 2019

Related U.S. Application Data

(63) Continuation of application No. 14/854,855, filed on Sep. 15, 2015, now abandoned.

(51) Int. Cl.
*B67B 3/20* (2006.01)
*B67B 3/28* (2006.01)

(52) U.S. Cl.
CPC ..... *B67B 3/2066* (2013.01); *B67B 3/202* (2013.01); *B67B 3/28* (2013.01)

(58) Field of Classification Search
None
See application file for complete search history.

(56) References Cited

U.S. PATENT DOCUMENTS 3,908,341 A * 9/1975 Conti ..... B67B 3/06 53/314
4,198,901 A * 4/1980 Knudsen ..... B31B 50/00 198/626.1
4,922,684 A * 5/1990 Nelson ..... B65D 41/3409 53/314
6,679,026 B1 * 1/2004 Cirio ..... B67B 3/2033 53/317

(Continued)

*Primary Examiner* — Hemant T Desai
*Assistant Examiner* — Tanzim Imam
(74) *Attorney, Agent, or Firm* — Baker & McKenzie

(57) ABSTRACT

The invention relate generally to a tightening mechanism for a bottle filling and capping system, and a bottle neck configuration. More specifically, the invention includes a machine for tightening plastic caps onto the threaded necks of plastic bottles, and bottle neck configuration that facilitates the capping process, both of which result in a simple and effective capping operation. A conveying assembly moves the bottle in a circular path where the neck of the bottle and the cap are brought together by moving the bottle under a cap that is loosely held at a particular elevation and angle by a feeder mechanism. The conveying system constricts the rotational movement of the bottle, and a neck support stabilizes the neck of the bottle vertically, as the cap is pressed onto the neck initially by a roller. A capping station in a bottle filling line is comprised of a spring biased toothed finger that engage the peripheral edge of the caps as the bottles are conveyed through the machine. Depending on various factors such as the number and circumferential length of the threads on the cap and bottle a second roller and (Continued)

second toothed finger will be used to complete the tightening process. When a capped bottle exits the capping station, the cap is fully engaged with the bottle in that it is tightened and in its final position relative to the bottle.

13 Claims, 3 Drawing Sheets

(56) References Cited

U.S. PATENT DOCUMENTS

| | | | | |
|---|---|---|---|---|
| 7,162,849 | B2 * | 1/2007 | Bernhard | B67B 3/2033 53/167 |
| 2007/0068117 | A1 * | 3/2007 | Lang | B67B 3/2033 53/331.5 |
| 2007/0261369 | A1 * | 11/2007 | Takahara | B67B 3/206 53/317 |

* cited by examiner

CAPPING SYSTEM

This Continuation application claims priority to U.S. parent patent application Ser. No. 14/854,855, which was filed on Sep. 15, 2015, which is incorporated herein by reference.

BACKGROUND AND SUMMARY

The capping system shown and described is for use in applying threaded caps onto the threaded necks of containers for beverages, such as milk, other dairy products and juice.

Bottlers of dairy and juice drinks often use blow-molded containers to deliver their beverage products to consumers. To reduce the amount of plastic used in such bottles, for cost and environmental reasons, the bottles have become increasingly thinner; and this progression has tended to make the bottles more flexible and difficult to control, particularly prior to being capped, i.e., in an unsealed condition (either filled or empty). This has made the capping process more difficult, and has required that the bottle be better supported during the capping operation in order to prevent buckling of the bottle as the cap is applied.

A problem with some capping machines is that they have complex capping stations with several large and expensive components, such as multiple rotary capping heads like those that are shown in FIG. 1 of U.S. Pat. No. 4,308,707; FIG. 2 of U.S. Pat. No. 5,218,811; and FIGS. 1 and 2 of U.S. Pat. No. 5,012,630. Some prior art capping stations include pivoting toothed fingers with vertical serrations that engage similarly configured serrations on a bottle cap. An example is U.S. Pat. No. 4,922,684 (hereinafter the '684 patent). But, the system of the '684 patent as a number of drawbacks, including inferior horizontal support for the neck of the bottle during the capping process, no vertical support (other than the bottle's own buckling strength) for the bottle neck during initial placement of the cap onto the bottle, and difficulty in adjusting the force applied by the toothed finger.

The capping system shown and describe herein includes a tightening mechanism for a bottle filling and capping machine, and a bottle neck configuration that receives a support in the form of hook providing both vertical and lateral support during the application process, all of which result in a simple and effective capping operation. A conveying assembly moves the bottle in a defined bottle pathway where the neck of the bottle and the cap are brought together by moving the bottle under a cap feeder that is loosely places a cap onto the bottle a particular elevation. The rotational movement of the bottle during installation of the threaded cap is generally prevented by either weight of the bottle applying a frictional force to a conveyor, or by restraint against rotation based on interference between the bottle and a guide rail, or a combination of these and other means for preventing or limiting rotation of the bottle as a threaded cap is applied to the neck. A neck support stabilizes the neck of the bottle vertically and laterally, as the cap is pressed onto the neck initially by a roller. A capping station in a bottle-filling line further includes a spring biased toothed finger that engages the peripheral edge of the caps as the bottles are conveyed through the machine. Depending on various factors such as the pitch, number and circumferential length of the threads on the cap and bottle a second roller and second toothed finger may be used to complete the tightening process. When a capped bottle exits the capping station, the cap is fully engaged with the bottle in that it is tightened and in its final position relative to the bottle. An additional optional feature of the system described herein is that the pressure applied by the toothed finger is adjustable. Finally, an important aspect of the system is that the bottle neck it shaped to include a groove that receives in a close-fitting way the support or hook that provides both lateral and vertical support to the bottle during the simplified capping operation.

BRIEF DESCRIPTIONS OF THE DRAWINGS

DETAILED DESCRIPTION

Figure 1:
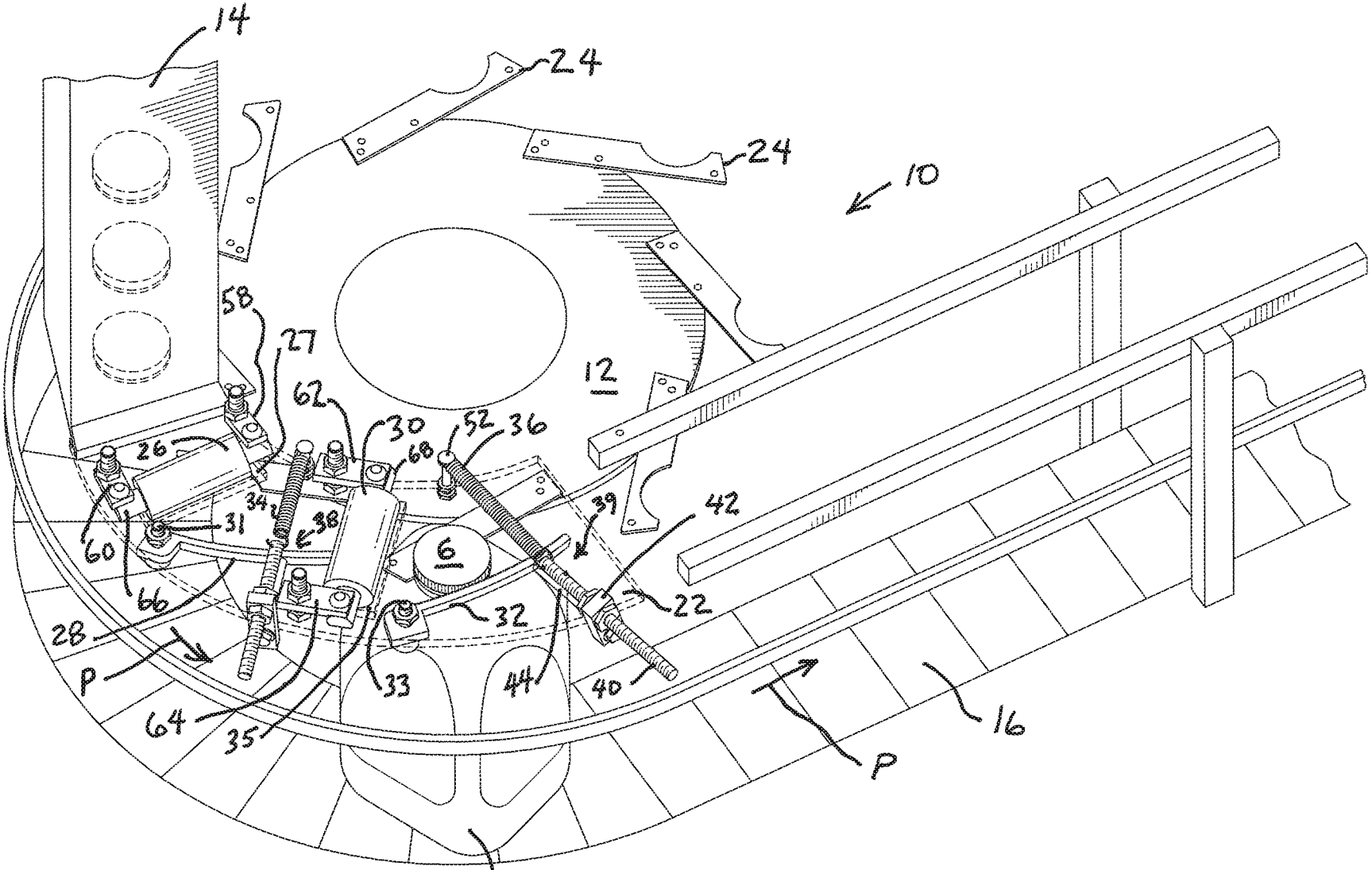
FIG. 1 is a perspective view of one example of a capping station that uses the present invention.
Figure 2:
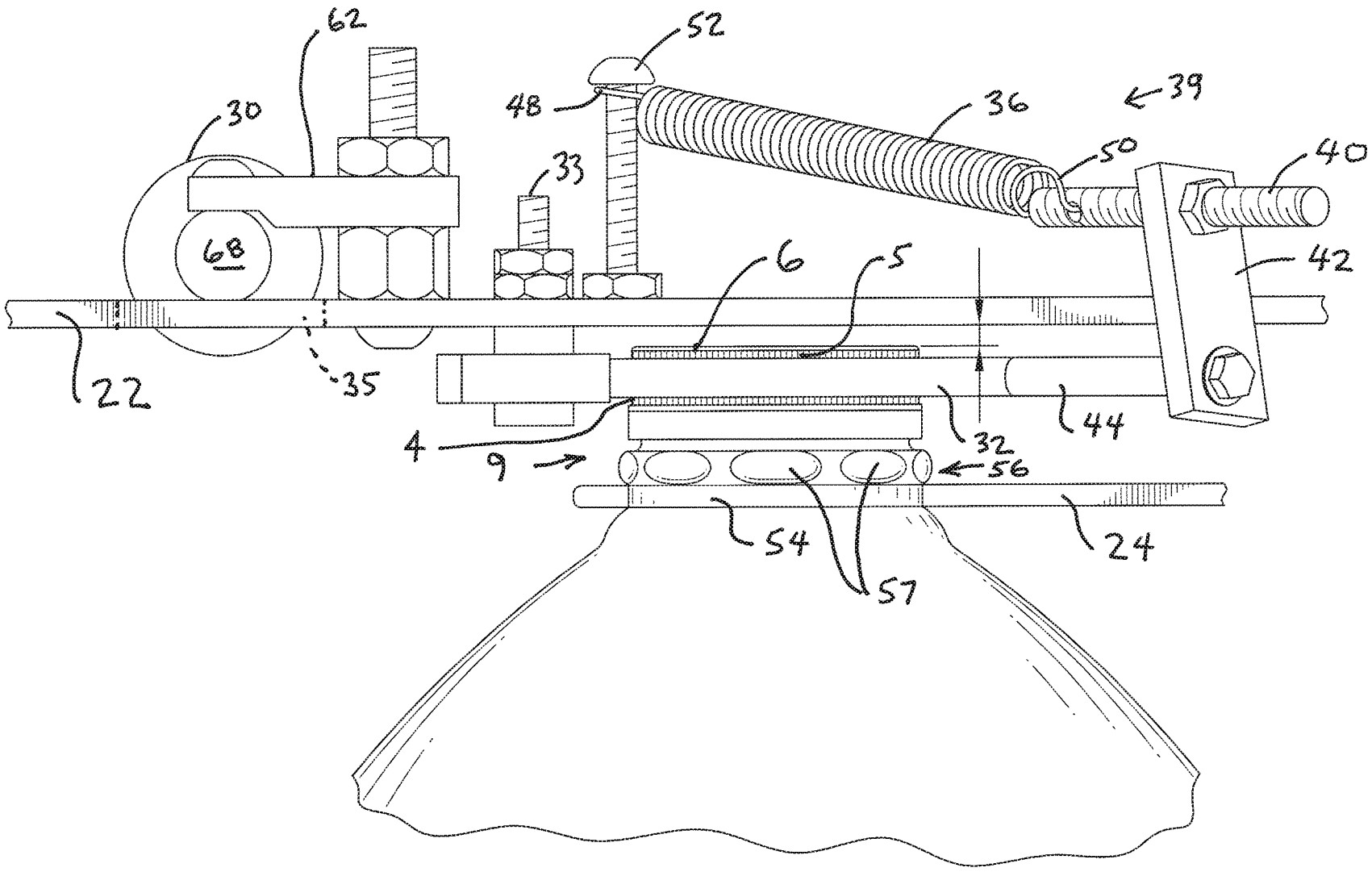
FIG. 2 is an elevational view of a bottle and cap as the cap is being tightened at the capping station of FIG. 1.

FIG. 1 is a perspective view of a portions of capping station 10 in a bottle-filling line in bottling facility. It should be noted that there are a number of details, such as supports and connecting structure that have been left out to show the structures that are relevant to the capping system described herein. In addition, the support plate 22 has been shown in phantom to allow various components that underlie the plate 22 to be seen more easily. That plate 22 is preferably a rigid steel and non-transparent component. The filling station 10 is shown as being part of a turret-style filling line, but the station could be part of a straight line arrangement, rather than the arcuate design that is typical and commonly used in many bottling facilities. Examples of existing, turret style filling lines and capping stations are shown in FIG. 2 of U.S. Pat. No. 5,218,811 and FIGS. 1 and 2 of U.S. Pat. No. 5,012,630. These two examples show large capping heads that engage a bottle cap and screw the cap into place on the bottle neck. Also existing in the prior art are a wide variety of cap-feeding apparatuses and related mechanisms such as vibratory feeder bowls and the like. The cap-feeder 14 of FIG. 1 is not shown in detail because such feeders are well known, and any of a number of such feeders may be used in conjunction with the invention that is shown and described herein.

FIG. 1 depicts portions of an example of a bottle transport system, including a conveyor 16 and capping station 10 (typically part of a larger filling line). The capping station 10 includes a rotating turret 12 that in this example has been modified to incorporate a hook 24 that engages a bottle 8 and brings the bottle 8 to a position under the outlet of the cap feeder 14. The hook 24 may be integral to the plate 22. Typically, the feeder 14 will present caps from a feeder bowl, one at a time. The caps 6 are placed onto the top of the neck 9 of the bottle 8, as the bottle is moved along the bottle pathway P. Shortly after a cap 6 is placed onto the neck 9 by the feeder 14 (as a result of the bottle being carried along a bottle pathway P), a first roller 36 presses the cap 6 onto the bottle neck 9 to begin the engagement between the internal threads (not shown) on the inside of the cap 6 and the external threads 7 on the neck 9.

The configuration of the capping station 10 in FIG. 1 includes a first roller 26 adjacent to and immediately downstream (or down the bottle pathway P, as defined by the rotation of the turret plate 12) of the feeder 14. The roller 26 extends through an opening 27 in the support plate 22, and presses the cap 6 onto the bottle neck 9. Then, downstream of the first roller 26, and disposed on the underside of the support plate 22, a toothed finger 28 engages the cap 6 to cause the cap 6 to rotate into further engagement with the external threads 7 on the neck 9. Optionally, and particularly when caps of fewer threads (such as a single thread), which typically require a greater amount of rotation to achieve full engagement and complete installation onto a bottle neck, the capping station 10 can be fitted with a second roller 30 (extending through an opening 35 in plate 22), and a second toothed finger 32, which are configured similar to the first roller 26 and the first toothed finger 28. The inventions shown and described are useable to install a variety of caps (including, but not limited to, four-thread or single-thread) onto a corresponding variety of bottle neck designs. As the thread configuration of the caps vary, so too vary the configurations of the bottle necks, since their thread designs need to match and be coordinated. The elevation of the support plate 22 is preferably arranged so that there is a gap D (See FIG. 2) that is about 1.35 mm (0.053 in) between the top of a fully installed cap and the underside of the support plate 22. The rollers 26 and 32 are preferably arranged to project about 5 to 6 mm below the bottom surface of the support plate 22, to provide an appropriate amount of vertical force to the cap, and to begin the threaded engagement between the cap 6 and the bottle neck 9. The downward force applied by to the cap 6 by the rollers 26 and 30 is resisted by an upward force applied to the cap 6 through the neck 9 by the engagement of the hook 24 with the groove 54, which pushes upward on the protrusions 56. The roller 26 is held in place by a pair of brackets 58 and 60, one on each side of the bottle pathway P. A similar pair of bracket 62 and 64 hold the second roller 30. The rollers 26 and 30 are mounted to a fixed an axle 66 and 68, respectively, and each roller is free to rotate about its respective axle.

The toothed fingers 28 and 32 are each biased (i.e., pulled) by a spring, 34 and 36, respectively, to apply a lateral force on the cap 6, which force is resisted by the hook 24 that holds the neck 9 of the bottle 8. The hook 24 also supports the neck 9 vertically as rollers 26 and 30 press downward on the cap 6. The vertical support is important, because the walls of many blow-molded bottles are quite thin and could buckle under forces applied by rollers in the absence of the vertical support provided by the hook 24.

The toothed finger 32 in FIG. 2 is configured to have vertically oriented teeth that match with splines 5 disposed on the exterior or the skirt 4 of the cap 6. Because vertically oriented teeth of the finger 32 match with the splines 5, the teeth of the fingers and splines 5 engage one another as the bottle 8 and cap 6 move along the bottle pathway P. This engagement and movement cause the toothed finger 28 to apply a tightening rotational force to the cap 6. If necessary, and particularly when a single-thread cap is used, two rollers 26 and 30 along with corresponding toothed fingers 28 and 32 may be used to further ensure that each cap 6 is fully tightened onto a container 8. The toothed fingers 28 and 32 and the rollers 26 and 30 operate and are supported (and in the case of the toothed fingers, adjusted) in substantially the same the way, and they cooperate to achieve a two-stage tightening force on the cap. The first toothed finger 28 is mounted to and under the support plate 22, and pivots about a pin 31 that extends through the support plate 22. Similarly, the second toothed finger 32 is mounted to and under the support plate 22, by a second pin 33 about which the second finger 32 pivots. As the bottle 8 passes along the bottle pathway P and splines 5 engage the teeth of the toothed finger 28, the spring 34 applies a tension force to the toothed finger, pulling the finger 28 against the cap 6. The toothed finger 28 pivots to allow the bottle 8 to pass along the bottle pathway, while applying a tightening force to the cap 6. The second toothed finger 32 operates in a substantially similar way, in that spring 36 pulls the finger 32 against the splines of the cap causing a tightening force to be applied to the cap 6. The lateral force applied by the finger 32 is resisted by the hook 24 applying an opposite force to the groove 54 formed in the neck 9 of the bottle 8 from the opposite side of the bottle 8.

FIGS. 1 and 2 show the mechanisms 39 that allow adjustment of the lateral forces that are applied by the toothed finger 32, via springs 36. The second toothed finger 32 shown in FIGS. 1 and 2 is as an example, but it should be understood that the adjustment of the first toothed finger 28 is substantially the same. A first end 48 of the spring 36 is attached to a pin 52 carried by the support plate 22. The opposite or second end 50 of the spring 36 is connected to a threaded rod 40 that is mounted to a connector 42. By moving the threaded rod 40 to different positions within the connector, the tension in the spring 36 may be increased or decreased. That increased or decreased tension is transferred to the toothed finger through the connector 42, around the support plate 22, through a rod 44 that is rigidly joined to both the toothed finger 32 and the lower end of the connector 42.

Figure 3:
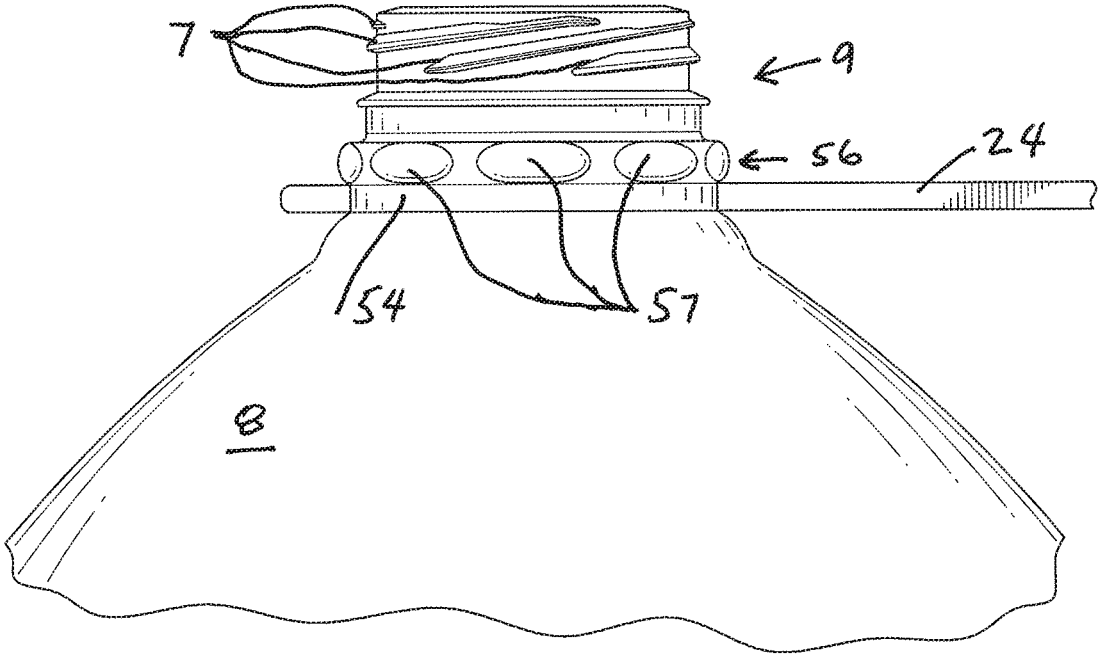
FIG. 3 is an elevational view of a neck support and bottle that is one example of an arrangement that uses the present invention.

The hook 24 is preferably a rigid metal component that closely fits into a groove 54 formed in the neck 9 of the bottle 8. The groove 54 should be located below an enlarged laterally extending protrusion or group of protrusions 56 that will have substantial enough structure and rigidity to withstand both the vertical forces applied to the neck 9 by the rollers 26 and 30 as well as the lateral forces applied by the toothed fingers 28 and 32. The hook placed into the groove 54 as a way of stabilizing and supporting the bottle 8 generally, and the neck 9 in particular, as the bottle moves along the bottle pathway P and is capped. The axial dimension of the groove 54 should preferably approximately match the thickness of the hook 24. Similarly the inner diameter of the hook 24 should closely match and be approximately equal to the outer diameter of the neck 9 at the location of the groove 54. The height or axial length of the groove 54 is preferably approximately between about 2.7 and about 3.0 mm (or between about 0.180 and 0.120 inches). To withstand the vertical and lateral forces applied by the rollers 26 and 30 and the toothed fingers 28 and 32, the enlarged neck section 56 is preferably formed as a series of outward protrusions 57 that can be as many as eight in number, as shown in FIG. 3, but can also be fewer in number, such as four. A series of separate protrusions 56, as opposed to a constant diameter section at that same elevation, provide the neck with greater structural strength, particularly as it relates to resisting vertical forces.

It should be noted that while the closure system discussed herein is useful for applying caps to container that are used to deliver beverages, the system of the present invention can be used in a wide variety of applications, including containers for medicines (solid, i.e., pills, and liquids) and a wide variety of other liquids and solids, such as syrups and spices, and other granular materials.

The foregoing descriptions of specific embodiments have been presented for purposes of illustration. They are only examples and are not intended to be a basis for limiting the scope of the inventions claimed below. For example, a particular configuration shown and discussed herein may show a multiple-part assembly, but persons of skill in the art may know of ways to reduce the numbers of parts by integrating or combining one or more of the components shown herein. It will be apparent to persons of ordinary skill in the field of closure systems that many modifications, variations and substitutions are possible in light of the above teachings. The embodiments were chosen and described in order to explain the principles of the inventions claimed below and to demonstrate practical application thereof, and to thereby enable others of ordinary skill in the art to utilize the claimed inventions.

I claim:

1. A closure system for a container, comprising:

a cap having a skirt with a thread on an inner surface of the skirt, and axially oriented splines on an outer surface of the skirt;

a bottle with a threaded neck configured to connect with the cap, the neck having a thread operable to engage the thread of the inner surface of the skirt of the cap, and a circumferential groove disposed below the thread of the neck; and a capping station in a bottle filling line, the capping station being disposed in the filling line along a bottle pathway in the filling line at a location downstream of a filling station and downstream of a cap feeder, the capping station including:

a non-rotating support with a roller coupled to the support;

a toothed finger disposed downstream of the roller, the toothed finger being:

disposed on an underside of the support, pivotably coupled to the support, biased toward the bottle pathway, and operable to engage the splines of the cap after the cap has been pressed onto the bottle by the roller;

a bottle transport mechanism operable to move a filled bottle under the cap feeder; and a neck-engaging hook coupled to an outer peripheral part of the bottle transport mechanism, the neck-engaging hook having a shape that fits into the circumferential groove, wherein the neck-engaging hook is disposed opposite the toothed finger such that a lateral force applied by the toothed finger is resisted by the neck-engaging hook applying an opposite force to the circumferential groove of the bottle from an opposite side of the bottle, wherein the circumferential groove is positioned below a plurality of protrusions, the protrusions being configured to provide rigidity to withstand vertical forces applied by the roller and the lateral force applied by the toothed finger, and wherein the circumferential groove has an axial dimension equal to a thickness of the neck-engaging hook.

2. The closure system of claim 1 further comprising a second roller disposed downstream of the toothed finger and downstream of the roller, and a second toothed finger downstream of the second roller.

3. The closure system of claim 1, wherein the splines of the skirt of the cap have a size and spacing corresponding to a size and spacing of teeth of the toothed finger, such that the toothed finger is operable to engage the splines and cause rotation of the cap onto the bottle as the bottle moves along the bottle pathway.

4. The closure system of claim 1, further comprising:

a spring operable to bias the toothed finger in a direction of the bottle pathway, the spring being disposed above the support and a first end of the spring being fixed; and a threaded rod disposed at a second end of the spring and coupled to a connector such that rotation of the threaded rod varies tension in the spring.

5. The closure system of claim 1, wherein the non-rotating support includes an opening, and the roller extends through the opening and toward the bottle pathway.

6. The closure system of claim 1, wherein the capping station includes a rotating turret operable to advance the bottle along an arcuate bottle pathway, and the neck-engaging hook is a discrete component coupled to a peripheral portion of the turret.

7. The closure system of claim 1, wherein the non-rotating support includes an opening, the roller extends through the opening and toward the bottle pathway, the non-rotating support includes a second opening, a second roller extends through the second opening and toward the bottle pathway, and a second toothed finger is disposed downstream of the second roller and operable to apply rotational forces to the cap in a tightening direction.

8. A closure system for a container, comprising:

a cap having a skirt with a thread on an inner surface of the skirt, and axial splines on an outer surface of the skirt;

a bottle with a threaded neck configured to connect with the cap, the neck having a thread operable to engage with the thread of the inner surface of the skirt of the cap, and a circumferential groove disposed below the thread of the neck; and a capping station in a bottle filling line, the capping station being disposed in the filling line along a bottle pathway in the filling line at a location downstream of a filling station and downstream of a cap feeder, the capping station including:

a non-rotating support with a roller coupled to the support;

a toothed finger disposed downstream of the roller, the toothed finger being:

disposed on an underside of the support, pivotably coupled to the support, biased toward the bottle pathway, and operable to engage the splines of the cap after the cap has been pressed onto the bottle by the roller;

a bottle transport mechanism operable to move a filled bottle under the cap feeder;

a neck-engaging hook having a semi-circular shape, the hook being coupled to an outer peripheral part of the bottle transport mechanism and having a shape that fits into the circumferential groove; and a tension adjustment mechanism including a spring, wherein:

the neck-engaging hook is disposed opposite the toothed finger such that a lateral force applied by the toothed finger is resisted by the neck-engaging hook applying an opposite force to the circumferential groove of the bottle from an opposite side of the bottle, the circumferential groove is positioned below a plurality of protrusions, the protrusions being configured to provide rigidity to withstand vertical forces applied by the roller and the lateral force applied by the toothed finger, the circumferential groove has an axial dimension equal to a thickness of the neck-engaging hook, a first end of the spring is coupled to the non-rotating support, a second end of the spring is coupled to a threaded rod adjustably connected to a connector, the connector is coupled to the toothed finger, and the tension adjusting mechanism is operable to adjust a tension on the spring when the threaded rod is rotated thereby adjusting a force applied by the toothed finger to the splines of the cap.

9. The closure system of claim 8, further comprising:

a second roller disposed downstream of the toothed finger and downstream of the roller; and a second toothed finger downstream of the second roller.

10. The closure system of claim 8, wherein the splines of the skirt of the cap have a size and spacing corresponding to a size and spacing of teeth of the toothed finger, such that the toothed finger is operable to engage the splines and cause rotation of the cap onto the bottle as the bottle moves along the bottle pathway.

11. The closure system of claim 8, wherein the non-rotating support includes an opening, and the roller extends through the opening and toward the bottle pathway.

12. The closure system of claim 8, wherein the capping station includes a rotating turret operable to advance the bottle along an arcuate bottle pathway, and the neck-engaging hook is a discrete component coupled to a peripheral portion of the turret.

13. The closure system of claim 8, wherein the non-rotating support includes an opening, the roller extends through the opening and toward the bottle pathway, the non-rotating support includes a second opening, a second roller extends through the second opening and toward the bottle pathway, and a second toothed finger is disposed downstream of the second roller and operable to apply rotational forces to the cap in a tightening direction.

* * * * *